United States Patent [19]

Zodrow

[11] 4,162,181

[45] Jul. 24, 1979

[54] LABELING STATION OF A MACHINE FOR LABELING OBJECTS, ESPECIALLY BOTTLES

[75] Inventor: Rudolf Zodrow, Dusseldorf, Fed. Rep. of Germany

[73] Assignee: Jagenberg-Werke Aktiengesellschaft, Dusseldorf, Fed. Rep. of Germany

[21] Appl. No.: 868,557

[22] Filed: Jan. 11, 1978

[30] Foreign Application Priority Data

Jan. 18, 1977 [DE] Fed. Rep. of Germany ..... 2701808

[51] Int. Cl.[2] ..... B65C 9/08; B41M 1/00

[52] U.S. Cl. ..... 156/384; 156/571

[58] Field of Search ..... 156/384, 571

[56] References Cited

U.S. PATENT DOCUMENTS

| | | | |
|---|---|---|---|
| 3,893,388 | 7/1975 | Kronseder | 156/571 |
| 4,040,887 | 8/1977 | Zodrow | 156/384 |

*Primary Examiner*—Douglas J. Drummond

*Attorney, Agent, or Firm*—Sprung, Felfe, Horn, Lynch & Kramer

[57] ABSTRACT

A labeling station in a machine of the type for labeling objects and having a plurality of successively disposed stations, comprising a gluing station a label magazine station and a label transfer station. The labeling station comprises at least one pickup element for labels rotatably mounted on a revolving carrier between the pickup surface thereof and the center of curvature thereof and which is driven so that upon moving past the stations on each revolution of the carrier, its receiving surface rolls against the upper flat label of the label magazine station. A marker is associated with each pickup element and has a field for at least one marking type thereon and is rotatably and pivotally mounted on the carrier and driven synchronously with the associated pickup element. The pivot point of the marker is diametrically opposite the type field, the radius of curvature of the type field and the eccentricity of the mounting of the pivot point of the marker is coordinated with the circulation path of the area to be printed on the pickup element to effect the rolling of the type field upon the receiving surface of the pickup element.

9 Claims, 15 Drawing Figures

3
P3

15
13
9
11
5
P1
P7
M1
K1
19
17
1
23
37
47
P5
38
41
43
45
7

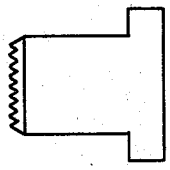
FIG. 13
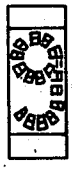
FIG. 14
FIG. 15
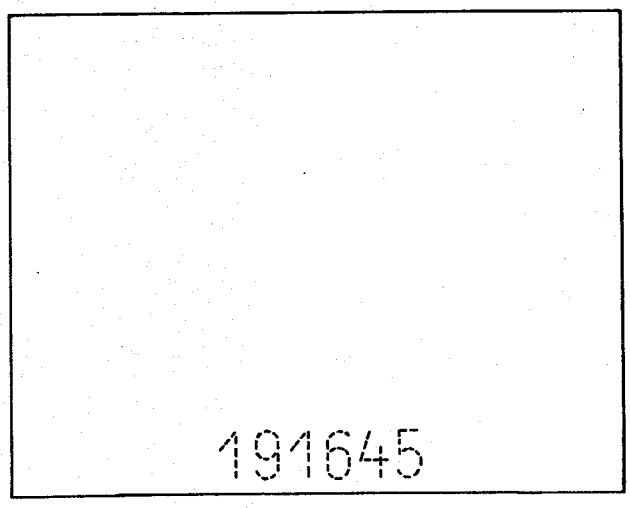

LABELING STATION OF A MACHINE FOR LABELING OBJECTS, ESPECIALLY BOTTLES

BACKGROUND

The invention relates to a labeling station of a machine for labeling objects, especially bottles, having a plurality of successively disposed stations, such as a gluing means, a label magazine station and a label transfer station, and having at least one label pickup element having an outwardly curved label receiving surface and mounted and driven eccentrically on a revolving carrier for rotation or pivoting between the receiving surface and the center of curvature such that, when it moves past the stations, its receiving surface rolls against the topmost, especially flat label at the label magazine station upon each revolution of the carrier.

In a labeling machine of this kind, the application of glue to the labels and the transport of the labels from the label magazine station, which is commonly in the form of a magazine receiving a stack of labels, to the label transfer station, which is commonly in the form of a labeling cylinder, are accomplished by the fact that, after glue has been applied to the receiving surface of the pickup element as it passes the gluing station, which is commonly in the form of a glue roller, this receiving surface rolls on the upper label and, due to the adhesion of the label to the receiving surface on account of the glue, removes the label from the label stack and carries it with it. The glue is applied only in the area in which the receiving surface rolls against the label. In order for such a rolling action to be possible when the labels lie flat in the label magazine, the pickup elements are journaled at a point between their cylindrically curved receiving surfaces and their center of curvature. The rotatory movement they perform when they roll along the straight line across the front of the label stack is accelerated and retarded by a special drive. The design of such a drive and the journaling of the pickup element is described in German Offenlegungsschrift No. 2,325,244. Instead of the cam-controlled planetary drive described therein, the pickup element can also be driven through an all-cam drive using two lever arms, which is described in German Offenlegungsschrift No. 2,552,253. If rotating pickup elements are not required and pivoting pickup elements will suffice, the pivoting movement can also be accomplished by means of a single cam-controlled lever arm.

It is desirable to put imprints or marks on the label at such labeling stations. In other kinds of known labeling stations, a stamping tool has been provided outside of the carrier on the path of circulation of the pickup elements between the other stations, which rotates on a stationary, driven shaft. The label held by the pickup element rolls a short distance against the embossing tool as it passes it. Since a relative movement can be approximately achieved between the stamping tool and the label only over a relatively short distance, a plurality of characters cannot be marked adjacent one another, but only one above the other. This means that the marks will run into the design on the label. Furthermore, it is disadvantageous that the pressures required for each type add up to a single total pressure, and this represents a considerable momentary load on the mounting.

In another labeling station, the stamping tool is disposed on the gripper cylinder behind an aperture and is advanced radially by driving means. On account of the small amount of space available at this point, the driving means and the stamping tool must be made quite small. It is disadvantageous that such stamping tools and their driving means are of complex construction and are subject to great wear.

THE INVENTION

The invention is addressed to the problem of providing, in a labeling station of the kind described in the beginning, a mark printing means for labels which will make it possible to mark the label longitudinally and will combine compact construction with reliability of operation.

This problem is solved by the invention in that with each pickup element there is associated a mark printing means which is journaled rotatably or pivotally on the carrier and is driven synchronously with the pickup element, which bears a field for at least one marking type in an outwardly curved plane, and whose rotation point is situated diametrically opposite the marking type field, the radius of curvature of the marking type field and the eccentricity of the bearing of the pivot point of the mark printing means being coordinated with the circulation path of the area of the pickup element where the mark is to be placed, such that the marking type field rolls upon the pickup element.

On the basis of the chosen geometrical conditions, the field containing the marking types rolls slip-free on the receiving surface in the area in which the marking is to be applied to the label. On account of this slip-free rolling, no smearing of the imprint can occur. Another advantage is that a plurality of marks can be applied adjacent one another in the circumferential direction. The horizontal stamping (stamping of the individual marks one after the other) signifies, in comparison with vertical stamping (simultaneous stamping of all of the marks), a lesser stress on the types and on the pickup element. In addition, the forces produced by the marking on the pickup element are transmitted directly to the mounting thereof.

If the rotatory or pivotal movement of the pickup element is irregular, the driving of the mark printing means is correspondingly irregular. The driving can be performed by means of a cam-controlled crank. The mark printing means, however, can also be coupled to the drive of the pickup element.

Basically, it is possible for the receiving surface of the pickup element to be solid, i.e., for the area on which the marking type field is to roll to be formed by the receiving surface. In such a case, the pickup element must withstand the pressure. For this reason it cannot be of the light construction which it could have were it not for this special function. In order nevertheless to have a light pickup element (low masses to be accelerated) and to have a sufficiently strong backing in the area in which the type field is to roll, this area can be constituted by a platen disposed in an aperture in the receiving surface of the pickup element, especially a pad directly supported against the drive shaft of the pickup element. Such a platen can be of sturdy construction. The reaction forces which occur when the marking types are inked are directly transmitted to the drive shaft of the pickup element. The same platen can be used in the case of differeing, replaceable pickup elements.

The marking, in the system of the invention, can consist of embossing, punching or stamping. If it is to be stamping, a common inking station is provided outside of the carrier in the space between the label magazine station and the label transfer station. It can consist of a circulating inking band touching upon the path of circulation of the pickup element. To create a compensation for the radial movement of the individual marking types, the inking band runs preferably over an inking roller which is under spring bias and engages the free section of the inking band.

An alternative arrangement of the inking station consists of two inking rolls tangent to the outer circumference of the path of circulation of the mark printing means and disposed successively along the path, of which the first, in the direction of circulation, serves for the inking of the rear half of the type field and the second in the direction of circulation serves for the inking of the forward half of the type field. With these two inking rolls it is possible, if the pivot point of the marking type field is displaced with respect to its radius of curvature, to ink the entire length of the marking type field, the pressure between the inking roll and the marking types being substantially uniform over the entire length of the field.

BRIEF DESCRIPTION OF THE DRAWINGS

The invention will now be further explained with the aid of drawing representing its embodiments.

FIG. 13 is a side elevational view of a mark printing type, FIG. 14 shows a front elevational view of the marking type of FIG. 13, and FIG. 15 shows a label provided with marks.

DETAILED DESCRIPTION OF THE INVENTION

Figure 1:
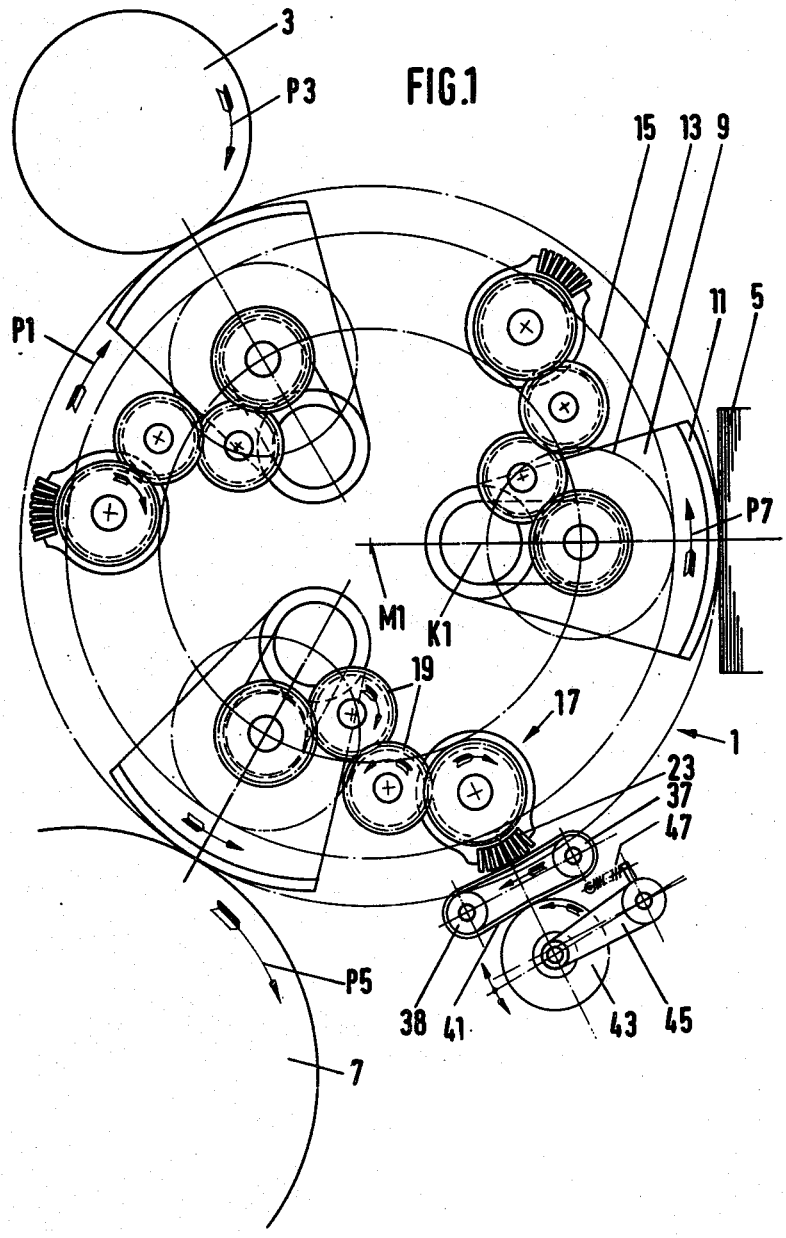
FIG. 1 is a diagrammatic top plan view of a labeling station.
Figure 2:
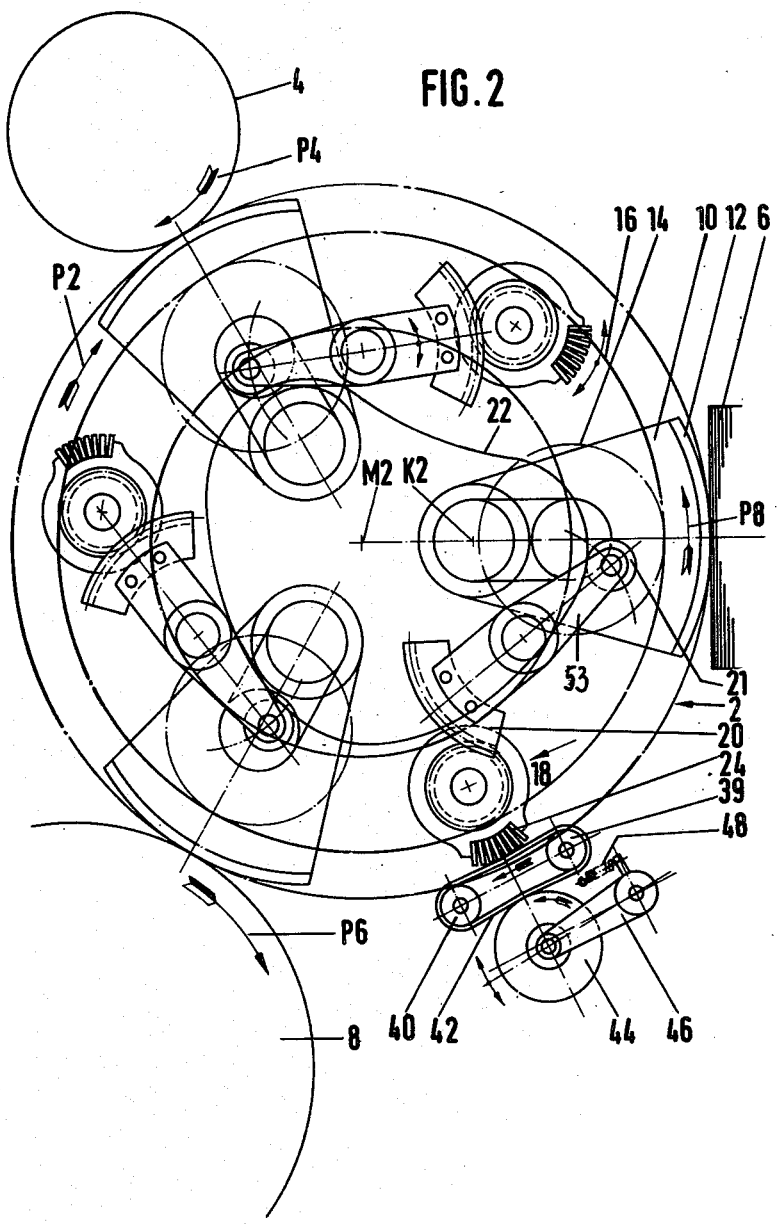
FIG. 2 is diagrammatic top plan view of a labeling station in which the driving of the mark printing means is different from that shown in FIG. 1.

The labeling stations of FIGS. 1 and 2 consist of a carrier 1, 2, rotating in the direction of the arrow P1, P2, and stations successively disposed on its periphery, namely a glue roll 3, 4, rotating in the direction of the arrow P3, P4, a stationary label magazine 5, 6, accommodating a label stack, and a gripper cylinder 7, 8, rotating in the direction of the arrow P5, P6. The glue roll 3, 4, and the gripper cylinder 7, 8, are coupled by gearing to the carrier 1, 2, for synchronous operation.

The carrier 1, 2, bears three similar pickup elements 9, 10, which are distributed eccentrically from the center point M1, M2, of the carrier 1, 2. Each pickup element 9, 10, has a cylindrically curved receiving surface 11, 12. The pickup element 9, 10, is rotatably journaled between this receiving surface 11, 12, and the corresponding center of curvature K1, k2. A planet gear 13, 14, which meshes with a fixed sun gear 15, 16, serves as the drive. When the carrier 1, 2, revolves, the planet gear 13, 14, rolls on the sun gear 15, 16, so that the pickup element 9, 10, revolves in the direction of the arrow P7, P8. To introduce an irregular rotatory movement into this rotation initiated by the regular rotation of the carrier, a cam control is provided in the gear train, which is described in detail in German Offenlegungsschrift No. 2,325,244. As already stated, a different drive for the individual pickup elements can, of course, be provided.

With each pickup element 9, 10, there is associated a mark printing means 17, 18, including a plurality of mark types 23, 24 which is disposed for rotation or pivoting movement on the carrier 1, in the free space between adjacent pickup elements 9, 10. In the embodiment shown in FIG. 1, the mark printing means 17 is driven through a plurality of gears 19 by the adjacent pickup element. In the embodiment shown in FIG. 2, the driving is accomplished by means of a pivotingly mounted toothed sector 20 having a cam follower 21 riding on a stationary cam 22. In either case, the drive permits an irregular rotatory or pivoting movement of the mark printing means 17, 18, when the latter cooperates with the pickup element 9, 10, during the marking action.

Figure 3:
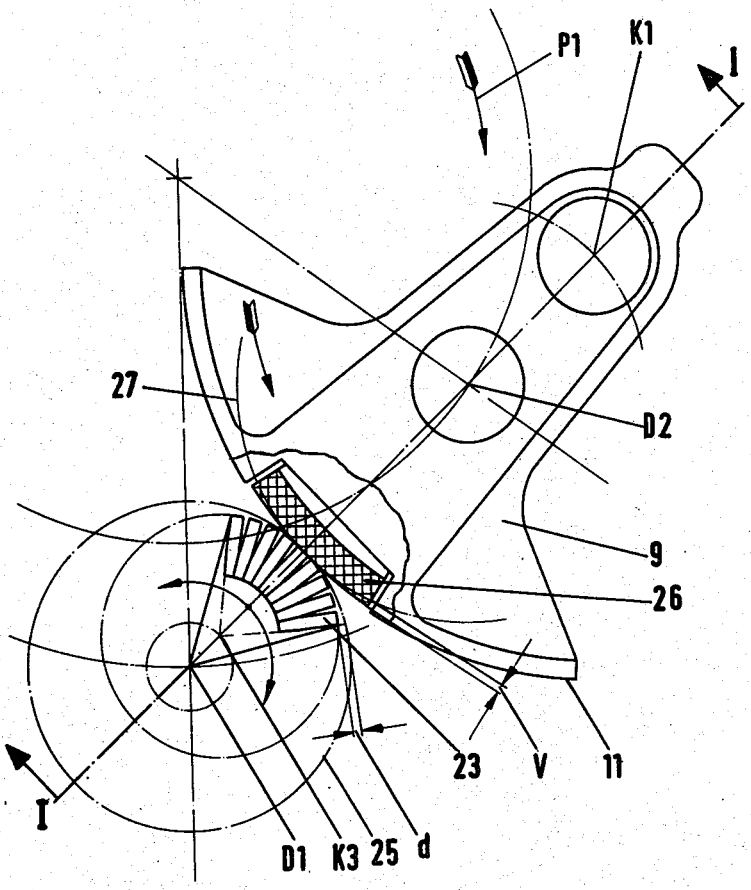
FIG. 3 is an enlarged plan view of a mark printing means cooperating with a pickup element.
Figure 5:
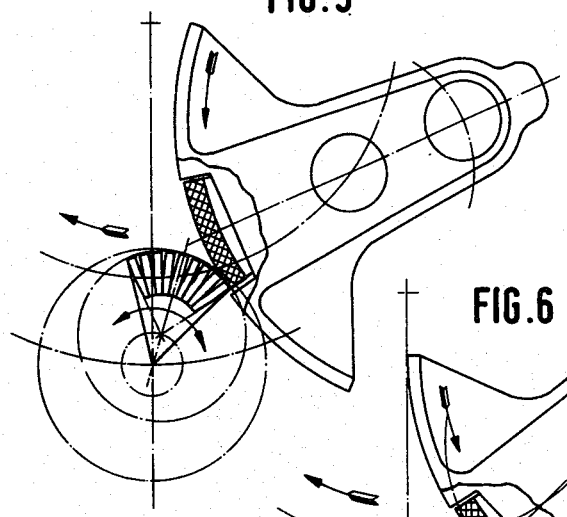
FIGS. 5–7 illustrate various phases of the movement of the mark printing means cooperating with the pickup element.
Figure 6:
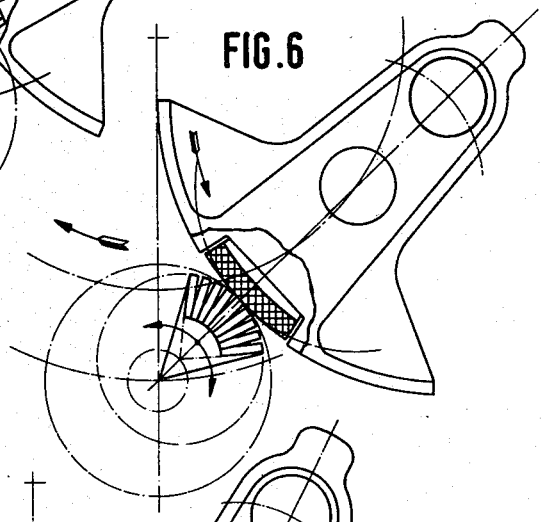
Figure 7:
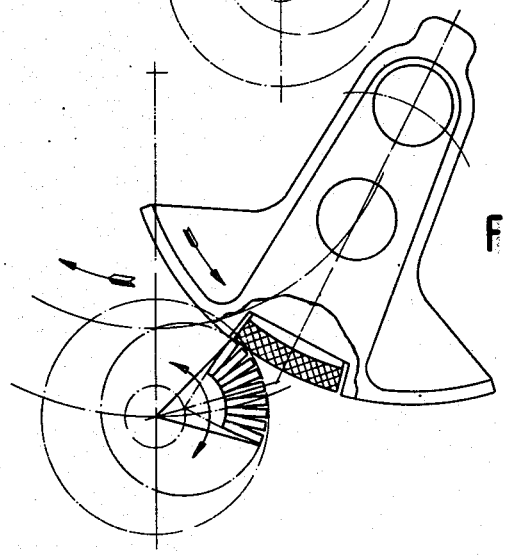

Each pickup element 9, 10, coacts with a plurality of marking types 23, 24, disposed horizontally in series, which form an outwardly curved cylindrical face. It can be seen in FIG. 3 that the radius of curvature of the marking types 23 is shorter than their circular path of movement 25, or that the pivot point D1 of the marking means is diametrically opposite the marking types 23 with respect to the center of curvature K3. It can furthermore be seen in FIG. 3 that, in the case of the pickup element 9, the situation is reversed, namely that the pivot point D2 of the pickup element 9 is located between the receiving surface 11 and its center of curvature K1. On account of these geometrical relationships, for the purpose of achieving a uniform pressure of the marking types 23 and of a rolling action over the entire length of the mark printing field, the set-back d at the beginning and at the end of the marking types 23 from the circle 25 is equal to the overreach v of the pressure pad 26 at its beginning and end with respect to the circle 27 which is tangent to the pressure pad 26 at the center of the latter and whose center coincides with the axis of rotation D2. FIGS. 5 to 7 show how these geometrical relationships produce their effect when the series of marking types 23 roll against the pressure pad 26. It can be seen that the pressure is equal over the entire length of the pressure pad 26.

Figure 4:
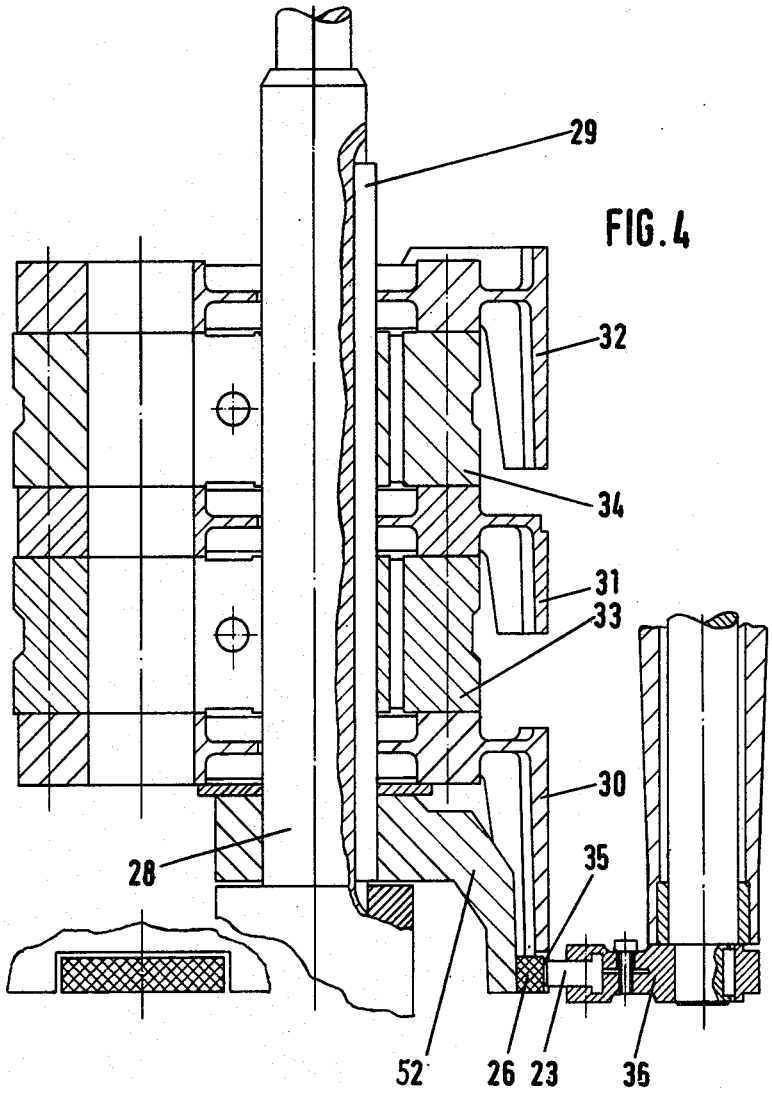
FIG. 4 is an axial cross sectional view taken along line I—I of FIG. 3.

As shown in FIG. 4, the pressure pad 26 is borne by a separate carrier 52, which is disposed on the drive shaft 27 of the pickup element, being affixed for rotation therewith by means of a key 29. The pickup element is triply divided, namely into a lower part 30 for the belly label, a middle part 31 for the breast label, and an upper part 32 for a foil. By means of spacing and fastening means 34, the pickup elements are disposed on the shaft 27 and are affixed thereto with the key 29. The pickup elements can be replaced with different shapes and sizes by virtue of this method of fastening. The bottom part 30 of the pickup element has in its receiving surface an aperture 35 in which the pressure pad 26 is disposed. The pressure pad 26 is suitable for a variety of shapes and sizes of pickup elements and does not have to be replaced. It can also be seen in FIG. 4 that the marking types are gripped in a groove in a holder 36.

Figure 8:
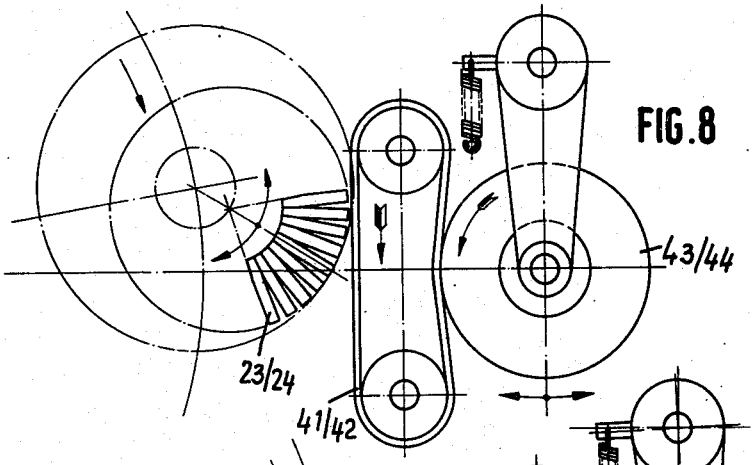
FIGS. 8–10 are plan views of the mark printing means cooperating with the inking station, in various phases of its movement.
Figure 9:
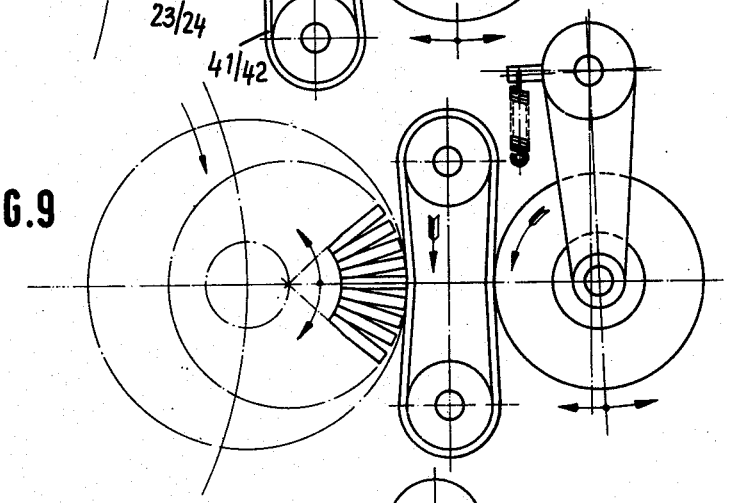
Figure 10:
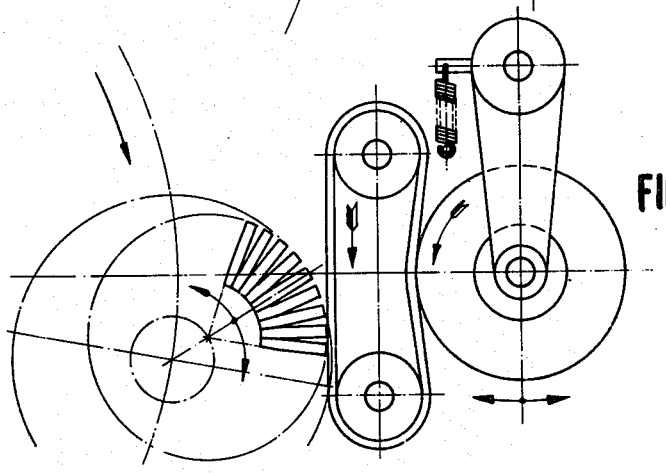

The inking station of FIGS. 8 to 10 can be used equally for the embodiments shown in FIGS. 1 and 2. The inking station of FIGS. 11 and 12 can also be used for the embodiment in FIG. 1, if the drive of the mark printing means can be operated in forward and reverse, but it is better suited to the embodiment shown in FIG. 2.

The inking station shown in the drawings, and thus the one in FIGS. 1 and 2, consists of a band 41, 42, running over two pulleys 37–38, 39–40, and disposed tangentially to the periphery of the outer path of circulation of the mark printing means 17, 18, and of an inking roller 43, 44, which is mounted pivotal on an arm 45, 46, and biased by the force of a spring 47, 48, against the free section of the band 41, 42. The band 41, 42, and the inking rolls 43, 44, can have their own drive or they can be driven by the mark printing means 17, 18, so that they rotate in the direction of the arrows.

For the purpose of compensating the different radial excursions of the marking types 23, 24, when the ink is applied by the band 41, 42, the band 41, 42, can be resiliently elastic. However, better experience has been had with a non-elastic band 41, 42, which is held in tension by the inking roller 43, 44. In FIGS. 8 to 10 is shown how the section of the band 41, 42, inking marking marking types 23, 24, yields upon contacting the marking types 23, 24. This yielding is compensated by a tensing of the other section which is engaged by the inking roller 43, 44, under spring bias.

Figure 11:
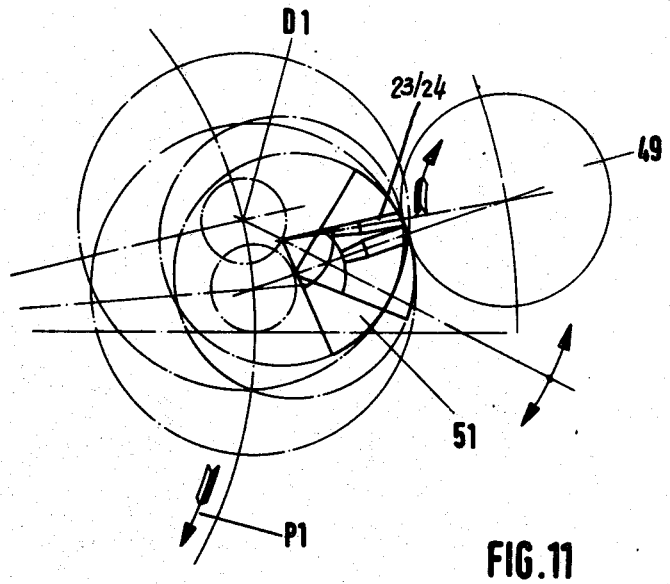
FIGS. 11 and 12 are plan views of a different inking station in various phases of its movement.
Figure 12:
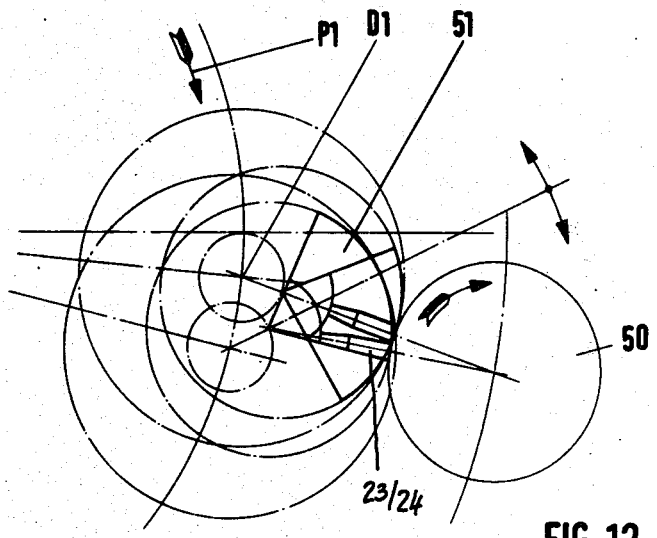

In the embodiment represented by FIGS. 11 and 12, the inking station consists of two inking rollers 49, 50, which are tangent with the rotational path of the marking types 23, 24, and are disposed successively in the circumferential direction. This arrangement of the two inking rollers 49, 50, assures, with the chosen geometry of the set of marking types and its position, that the field of marking types can be uniformly inked over its entire length. In FIG. 11 it is shown that the set of marking types represented by a triangle 51 contacts the inking roller 49 with its rear edge. When the carrier rotates in the direction of the arrow P1, the pivot point D1 moves downwardly. At the same time, the set of marking types pivots counterclockwise about the pivot point D1, whereupon its rear half rolls on the inking roller 49. The set of marking types 51 is held in this middle position by the cam control until it reaches the position shown in FIG. 12 and becomes tangent at its center with the inking roller 50. As the carrier continues to turn in the direction of the arrow P1, the pivot point D1 of the marking element migrates downwardly. At the same time, the set of marking types 51 is pivoted counterclockwise, so that it rolls against the inking roller 50 all the way to its rear edge. The inking rollers 49, 50, are freerunning, so that they can adapt themselves to the rolling speed of the set of marking types 51.

FIGS. 13 and 14 are detailed views of the marking type 51, with FIG. 13 being a side view and FIG. 14 being a front view showing an example of a marking type for the number 9. FIG. 15 shows a label which has been marked in the central lower portion thereof.

It will be appreciated that the instant specification and claims are set forth by way of illustration and not limitation, and that various modifications and changes may be made without departing from the spirit and scope of the present invention.

What is claimed is:

1. A labeling station in a machine of the type for labeling objects, especially bottles, and having a plurality of successively disposed stations, comprising a gluing means, a labeling magazine station having an upper portion for holding flat labels and a label transfer station, said labeling station comprising: at least one pickup element for labels having an outwardly curved receiving surface, a revolving carrier, means rotatably mounting each pickup element on the carrier and between the pickup surface and the center of curvature, means driving each pickup element such that upon moving past the stations upon each revolution of the carrier, its receiving surface rolls against the upper flat label of the label magazine station, marking means associated with each pickup element and having a field for at least one marking type, means rotatably and pivotally mounting each marking means on the carrier and for driving same synchronously with the associated pickup element wherein the pivot point thereof is diametrically opposite the type field, the radius of curvature of the type field and the eccentricity of the mounting of the pivot point of the marking means is coordinated with the circulation path of the area to be printed on the pickup element to effect the rolling of the type field upon the receiving surface of the pickup element.

2. The labeling station of claim 1, wherein driving means of the marking means is responsive to the irregularity of the rotatory or pivotal movement of the pickup element to drive the marking means with corresponding irregularity.

3. The labeling station of claim 1, wherein the driving means for the marking means comprises a cam-controlled crank.

4. The labeling station of claim 1, wherein driving means of the marking means is coupled to the driving means of the associated pickup element.

5. The station of claim 1, wherein the rolling area of the marking type field comprises a backing means including a pressure pad, disposed in an aperture in the receiving surface of the pickup element, which is supported directly on the pickup element.

6. The labeling station of claim 1, further comprising a common inking station provided for the marking means outside of the carrier in the direction of circulation between the label magazine station and the label transfer station.

7. The labeling station of claim 6, wherein the inking station comprises circulating inking band tangent to the outer circle of the circulation path of the marking means.

8. The labeling station of claim 7, further comprising an inking roller running over the inking band and which is under spring force and lies upon the free section of the inking band.

9. The labeling station of claim 6, wherein the inking station comprises two rotatable inking rollers disposed successively in the path direction and tangent to the outer circle of the circulation path of the marking means, of which the first half in the direction of circulation serves for the inking of the rear half and the second in the direction of circulation serves for the inking of the forward half.

* * * * *